US005595831A

United States Patent [19]

Clark

[11] Patent Number: 5,595,831

[45] Date of Patent: Jan. 21, 1997

[54] CADIUM-FREE CORROSION PROTECTION FOR TURBINES

[76] Inventor: Eugene V. Clark, 7327 Elmo St., Tujunga, Calif. 91042

[21] Appl. No.: 440,849

[22] Filed: May 15, 1995

Related U.S. Application Data

[63] Continuation-in-part of Ser. No. 190,678, Jan. 31, 1994, abandoned, and Ser. No. 188,968, Jan. 28, 1994, abandoned.

[51] Int. Cl.[6] ..... B32B 15/18; F01D 5/28

[52] U.S. Cl. ..... 428/679; 428/680; 428/685; 427/328; 427/405; 416/241 R

[58] Field of Search ..... 428/679, 677, 428/658, 659, 680, 685; 416/241 R; 427/328, 405

[56] References Cited

U.S. PATENT DOCUMENTS

| | | | |
|---|---|---|---|
| 2,419,231 | 4/1947 | Schantz | 428/658 |
| 2,918,722 | 12/1959 | Kenmore | 428/658 |
| 3,064,337 | 11/1962 | Hammond et al. | 428/658 |
| 3,779,719 | 12/1973 | Clark et al. | 29/197 |
| 4,013,488 | 3/1977 | Ramqvist et al. | 428/679 |
| 4,329,402 | 5/1982 | Hyner et al. | 428/621 |
| 4,374,902 | 2/1983 | Smith et al. | 428/679 |
| 4,508,600 | 4/1985 | Irie et al. | 205/246 |
| 4,969,980 | 11/1990 | Yoshioka et al. | 205/217 |
| 4,971,624 | 11/1990 | Clark et al. | 75/238 |
| 4,975,337 | 12/1990 | Hyner et al. | 428/658 |
| 5,059,493 | 10/1991 | Takahata | 428/658 |
| 5,246,786 | 9/1993 | Usui | 428/658 |

FOREIGN PATENT DOCUMENTS

| | | | |
|---|---|---|---|
| 58-45396 | 3/1983 | Japan | 205/246 |
| 59-162292 | 9/1984 | Japan | 428/658 |

OTHER PUBLICATIONS

J. W. Dini et al., "Electrodeposition of Zinc–Nickel Alloy Coatings", Metal Finishing, Sep. 1979, pp. 53–57.

*Primary Examiner*—John Zimmerman
*Attorney, Agent, or Firm*—Louis J. Bachand

[57] ABSTRACT

Steam or gas turbine components comprising chromium steel have their fluid directing surfaces protected from corrosion by a surface layer coating consisting essentially of major weight amount of nickel and minor weight amounts of zinc, optionally with boron added, over a nickel preplate which limits deleterious diffusion of zinc into the surface substrate.

15 Claims, 1 Drawing Sheet

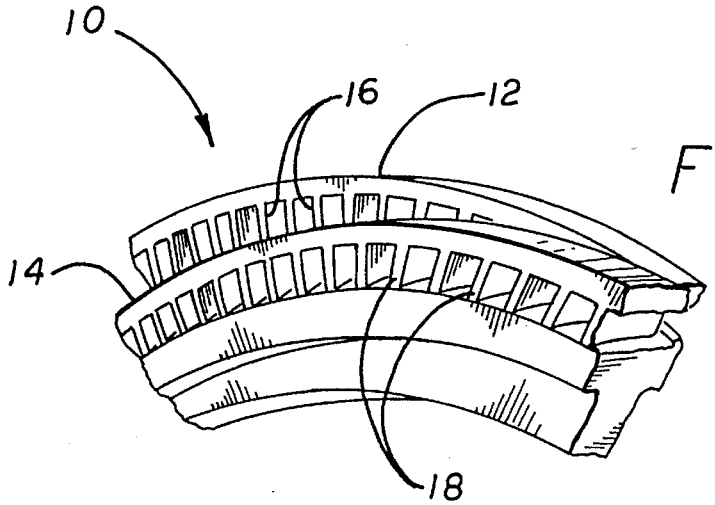
FIG. 1
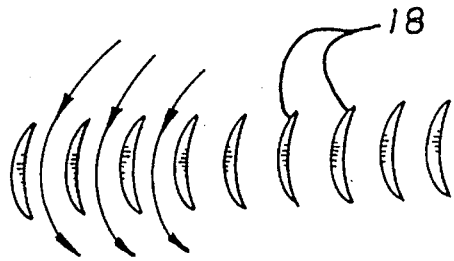
FIG. 2
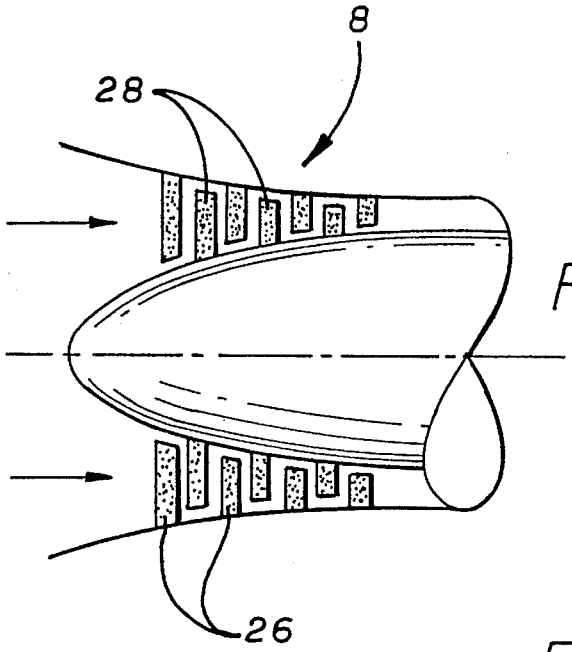
FIG. 3
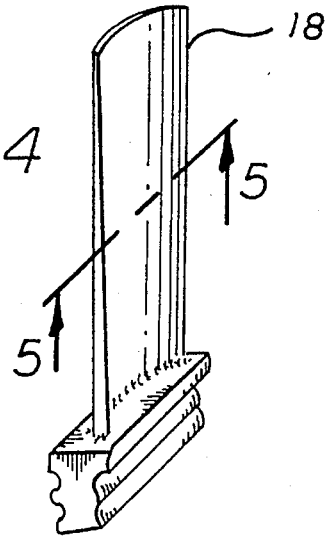
FIG. 4
FIG. 5
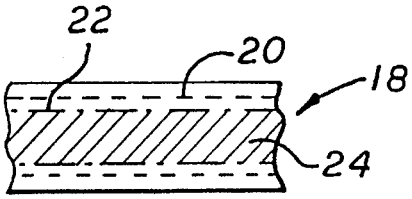

CADIUM-FREE CORROSION PROTECTION FOR TURBINES

REFERENCE TO RELATED APPLICATIONS

This application is a continuation-in-part of my application Ser. No. 08/190,678, filed Jan. 31, 1994, now abandoned, and is further a continuation-in-part of my application Ser. No. 08/188,968, filed Jan. 28, 1994, now abandoned, the disclosures of which are hereby incorporated by this reference.

TECHNICAL FIELD

This invention has to do with providing corrosion protection for turbine components, such as particularly the fluid directing surfaces of steam or gas turbine components including blades and vanes. More particularly, the invention relates to corrosion protection without the use of cadmium.

BACKGROUND OF THE INVENTION

Steam turbines are used primarily by utilities to generate electricity. Steam drives the turbines by impinging on fluid directing surfaces, including the blades of rotors and the static array of vanes surrounding the rotor to direct the steam onto the blades. Other fluid directing surfaces that are subject to corrosion include piping and valves. Gas turbines in their compression stages have similar fluid directing surfaces similarly subject to corrosion. The term turbine components herein refers to apparatus operatively associated with a steam or gas turbine and having a fluid directing surface subject to corrosion unless coated with a protective coating. Corrosion is a problem in turbines because it roughens the fluid directing surfaces, and on blades and vanes changes the gas or steam flow characteristic, and in general alters the shape and relationship of the fluid directing surfaces, releases erosive particulate downstream, and in divers ways adversely affects the performance of the turbine. Steam turbines are typically run for several years between overhauls and corrosion must be minimized over these long periods of operation. Gas turbines are costly to disassemble and overhaul.

SUMMARY OF THE INVENTION

Nickel cadmium protective coatings on turbine blades and vanes afford protection but the continued use of cadmium is environmentally disfavored. Substitution of zinc for cadmium is problematical since zinc diffusion into the blade or vane is deleterious to their fatigue and impact strength.

It is an object therefore of the present invention to provide corrosion resistant turbine components, and more particularly to provide a protective coating on such components without the use of cadmium. It is another object to provide a nickel zinc protective coating on steam and gas turbine components free of zinc penetration into the substrate. It is another object to provide an interlayer of low zinc diffusivity metal between a nickel zinc protective coating and the substrate to be protected such as a chromium steel. It is another object to provide increased hardness against erosion in such protective coatings by the addition of minor amounts of boron in the coating layer.

These and other objects to become apparent hereinafter are realized in accordance with the invention by the method of protecting fluid directing surfaces of turbine components from environmental corrosion including depositing onto the component surfaces to be protected a coating layer consisting essentially of nickel and zinc in a weight ratio of 65–80% nickel and 20–35% zinc, and in advance thereof plating the component surfaces with nickel metal having low diffusivity to zinc to limit the penetration of zinc into the component surface from the coating layer to less than occurs in the absence of the metal.

In this and like embodiments, there is further included selecting a component surface comprising a chromium steel having from about 5% chromium to 12% by weight chromium content; hydrogen stress relieving the coated component surface; and co-depositing in the coating layer up to 2 weight percent boron based on the combined weight in the coating layer of the nickel and zinc to harden the coating layer against erosion.

In a more preferred embodiment, the invention provides a method of protecting fluid directing surfaces of steam or gas turbine components comprising chromium steel from environmental corrosion including chemically depositing onto the component surfaces to be protected a coating layer consisting essentially of nickel and zinc in a weight ratio of 65–80% nickel and 20–35% zinc, and in advance thereof plating the component surfaces with a nickel metal having low diffusivity to zinc to limit the penetration of zinc into the component surface from the coating layer.

In this and like embodiments there is further included building the coating layer to a thickness of about 0.0004–0.0005 inch; plating the low diffusivity nickel metal to a thickness of 20–50 microinches; hydrogen stress relieving the coated component surface; co-depositing in the coating layer up to 2 weight percent boron based on the combined weight in the coating layer of the nickel and zinc to harden the coating layer against erosion.

The invention further contemplates providing an environmental corrosion resistant fluid directing component of a turbine comprising a fluid directing chromium steel surface having thereon a coating layer consisting essentially of nickel and zinc in a weight ratio of 65–80% nickel and 20–35% zinc, and interposed between the surface and the coating layer a low diffusivity nickel metal layer to limit the penetration of zinc into the component surface from the coating layer to less than occurs in the absence of the metal.

In this and like embodiments, typically the coating layer has a thickness of about 0.0004–0.0005 inch, the low diffusivity metal has a thickness of 20–50 microinches, the coating layer consists essentially by weight of 75% nickel and 25% zinc, and up to 2% by weight of boron is present in the coating layer based on the combined weight of nickel and zinc in the coating layer.

In a further embodiment the invention provides a fluid directing component comprising a chromium steel surface and having a surface coating layer consisting essentially of a major weight percent, e.g. 65–80% by weight nickel and a minor weight percent, e.g. 20–35% by weight zinc, and interposed between the surface and the coating layer from 20 to 50 microinches of plated nickel to block diffusion of the coating layer zinc to the chromium steel surface.

BRIEF DESCRIPTION OF THE DRAWINGS

The invention will be further described in conjunction with the attached drawing, in which:

FIG. 1 is a fragmentary view in perspective of arcuate sections of steam turbine blade and vane assemblies according to the invention;

FIG. 2 is a schematic view of the flow path between the steam turbine vanes;

FIG. 3 is a vertical section of a gas turbine;

FIG. 4 is an elevational view of a turbine blade having the invention coating thereon; and, FIG. 5 is a view taken on line 5—5 in FIG. 4.

DETAILED DESCRIPTION

With reference now to the drawing in detail, a steam turbine is illustrated at 10 in FIG. 1 including a vane assembly 12 and a blade assembly 14, juxtaposed such that steam flows from the relatively fixed vane assembly, at angles guided by the vanes 16, into the blade assembly where the steam impinges on the blades 18 and causes the blade assembly to rotate relative to the vane assembly. In FIG. 2, the path of the steam between blades 18 is shown, the actual impingement not being shown.

In FIGS. 4 and 5, blade 18 is shown having the nickel zinc coating layer 20 (dash line) underlaid by a low diffusivity nickel metal at 22 (dot dash line) on top of the base metal chromium steel 24.

In FIG. 3, a gas turbine is depicted at 8 having stators 26 and rotors 28, each comprised of an arcuate series of vanes and blades generally in the manner of the steam turbine assemblies shown in FIG. 1 with each pair of rotors and stators defining a compression stage. The respective turbine blades and vanes are coated in the same manner as the steam turbine blade shown in FIGS. 4 and 5.

As noted above, the present invention provides a corrosion resistant layer on chromium steels of the type typically used in steam and gas turbine component applications. The chromium steel will typically have a minimum by weight of at least 5% chromium and preferably at least 9% and up to 12% or more by weight chromium in particular applications. Turbine components treated with the present method need only have their fluid directing surfaces formed of the noted chromium steels for effective use of the invention, rather than the entire component so formed.

It has been found that an effective coating layer is formed by first plating the area to be protected with the nickel low zinc diffusivity metal in a thickness sufficient to impede or preferably block incursion of zinc from the coating layer into the substrate chromium metal. Thickness of 20 to 50 microinches are suitable. Thereafter the strike coat of low diffusivity nickel metal is plated over by a conventional electroplate or electroless process for codepositing nickel and zinc, and optionally boron.

EXAMPLE

A coupon having the chromium steel composition of a steam or gas turbine vane was given a chloride nickel strike of 20–50 microinches from a Watts nickel bath. The coupon was dipped in a co-deposit bath of zinc chloride (4.5 oz./gal.), nickel chloride of 32 oz./gal., and a proprietary brightener at 1–5% by volume. Plating conditions were 105° F., pH 5.9, current density 15 A/sq. ft., with zinc and nickel anodes. Under these conditions a coating layer thickness between 0.0004 and 0.0005 inch comprising 75% nickel and 25% zinc by weight is realized. Evaluation of the coupon in simulated corrosion environment showed remarkable resistance, comparable to cadmium containing nickel coatings heretofore used, but which are now environmentally undesirable.

An electroless bath of the boron type is advantageously used for its addition of boron to the coating layer, at up to 2% based on the weight of the coating, i.e. the nickel and zinc components of the coating as set out herein. The presence of boron adds hardness to the coating layer and erosion resistance.

In a CONTROL test, the above example is repeated but omitting the nickel strike step. In tests it is shown that the zinc from the nickel zinc coating layer diffuses into the substrate. Added zinc in the substrate is known to adversely affect both fatigue and impact strength.

It is most desirable to have minor amounts of about 25% by weight zinc in the coating layer, or more broadly from 20 to 35% by weight of the coating layer. The amount of nickel used is a major amount in the coating layer and is complementary to the zinc used up to 100% and can be from 65 to 80% by weight, and optimally about 75%.

Coating thickness is not narrowly critical, with a minimum being 0.0001 and the maximum being that practical in making the coating layer, e.g. up to 0.0012 inch.

It is desirable to hydrogen stress relieve the coated component surface by conventional means.

The invention thus provides a steam or gas turbine component highly resistant to corrosion and free of cadmium.

I claim:

1. Method of protecting from environmental corrosion fluid directing surfaces of steam or gas turbine components comprising chromium steel having a 5 to 12% by weight chromium content, including depositing onto the component surfaces to be protected a nickel-zinc coating layer in a weight ratio of 65–80% nickel and 20–35% zinc, and in advance thereof plating said component surfaces with nickel having low diffusivity to zinc to limit the penetration of zinc into said component surface from said coating layer.

2. The method according to claim 1, including also hydrogen stress relieving said coated component surface.

3. The method according to claim 1, including also co-depositing in said coating layer up to 2 weight percent boron based on the combined weight in said coating layer of said nickel and zinc to harden said coating layer against erosion.

4. Method of protecting from environmental corrosion fluid directing surfaces of steam or gas turbine components comprising chromium steel having a 5 to 12% be weight chromium content, including chemically depositing onto the component surfaces to be protected a coating layer consisting essentially nickel and zinc in a weight ratio of about 75% nickel and about 25% zinc, and in advance thereof plating said component surfaces with nickel to limit the penetration of zinc into said component surface from said coating layer.

5. The method according to claim 4, including also building said coating layer to a thickness of about 0.0004–0.0005 inch.

6. The method according to claim 5, including also plating said low diffusivity metal to a thickness of 20–50 microinches.

7. The method according to claim 4, including also hydrogen stress relieving said coated component surface.

8. The method according to claim 7, including also co-depositing in said coating layer up to 2 weight percent boron based on the combined weight in said coating layer of said nickel and zinc to harden said coating layer against erosion.

9. The method according to claim 4, including also co-depositing in said coating layer up to 2 weight percent boron based on the combined weight in said coating layer of said nickel and zinc to harden said coating layer against erosion.

10. An environmental corrosion resistant fluid directing component of a steam or gas turbine comprising a fluid directing chromium steel surface comprising 5 to 12% by weight chromium having thereon a coating layer consisting essentially of nickel and zinc in a weight ratio of 65–80% nickel and 20–35% zinc, and having interposed between said surface and said coating layer a nickel layer to limit the penetration of zinc into said component surface from said coating layer.

11. Turbine component according to claim 10, in which said coating layer has a thickness of about 0.0004–0.0005 inch.

12. Turbine component according to claim 10, in which said plated nickel has a thickness of 20–50 microinches.

13. Turbine component according to claim 10, in which said coating layer consists essentially by weight of 75% nickel and 25% zinc.

14. Turbine component according to claim 13, in which up to 2% by weight of boron is present in said coating layer.

15. A fluid directing component comprising a chromium steel surface comprising 5 to 12% by weight chromium and having a surface coating layer consisting essentially a major weight percent of nickel and a minor weight percent zinc, and interposed between said surface and said coating layer from 20 to 50 microinches of plated nickel effective to block diffusion of said coating layer zinc to said chromium steel surface.

* * * * *